US005746387A

United States Patent [19]

Pretto et al.

[11] Patent Number: 5,746,387

[45] Date of Patent: May 5, 1998

[54] HYBRID COMPOSITE EXPANDABLE SHAFT

[76] Inventors: Alessio G. Pretto, RD2, Box 414 Wilkinson Hollow Rd., Pawling, N.Y. 12564; John A. Pretto, 100 Union City Rd., Prospect, Conn. 06712

[21] Appl. No.: 604,152

[22] Filed: Feb. 20, 1996

[51] Int. Cl.[6] ..... B65H 75/24; B65H 75/08

[52] U.S. Cl. ..... 242/571.2; 242/613.5

[58] Field of Search ..... 242/571.2, 613.4, 242/613.5

[56] References Cited

U.S. PATENT DOCUMENTS

| | | | |
|---|---|---|---|
| 1,599,504 | 9/1926 | Underwood | 242/613.4 X |
| 2,856,137 | 10/1958 | Howsam | 242/613.4 X |
| 3,945,555 | 3/1976 | Schmidt | 228/126 |
| 4,000,896 | 1/1977 | Lauraitis | 473/319 |
| 5,379,964 | 1/1995 | Pretto et al. | 242/571.2 |

FOREIGN PATENT DOCUMENTS

| | | | |
|---|---|---|---|
| 1024343 | 2/1958 | Germany | 242/613.5 |

*Primary Examiner*—Daniel P. Stodola
*Assistant Examiner*—Gregory J. Strimbu
*Attorney, Agent, or Firm*—Edward R. Hyde

[57] ABSTRACT

An expandable shaft of the slotted type made of metal and a fiber and resin composite material. The shaft is formed of an elongated shell having hollow portions filled with a fiber/resin material.

7 Claims, 3 Drawing Sheets

HYBRID COMPOSITE EXPANDABLE SHAFT

BACKGROUND OF THE INVENTION

1. Field of the Invention

The present invention relates to drive mandrels or shafts for gripping the internal surfaces of sleeves or tubes on which web material may be wound.

In the winding and rewinding of web material such as paper, cloth and other sheet material, the web is wound on a sleeve or tube having an inside diameter slightly larger than the shaft on the winding mechanism. In this manner the sleeve may readily be slipped on and off the shaft. As a result an arrangement must be provided to effect a secure driving connection between the shaft and sleeve upon which the web material is wound. Accordingly, there exists shafts that are expandable to grip against the web sleeve to provide secure driving engagement.

The present invention is directed to such expandable shafts and the method of making them that provides functional and structural advantages over present expandable shafts.

2. Description of the Prior Art

Expandable shafts or mandrels are generally constructed with elements on the surface adapted to be extended radially outward by inflation of bladders within the shaft. Shaft designs fall into two general categories, the lug/button type and slotted rail type. The former contemplates a number of discreet lugs located at different points along the shaft. Customarily there is a bladder located within the shaft that are appropriately inflated to cause the lugs to extend radially outward to grip the web sleeve that surrounds the shaft. The slotted type of expandable shaft customarily includes a plurality of equally spaced slots around the circumference of the shaft and elongated pressure elements located within the slots. Individual bladders located within the shaft slots are inflated to bear against the pressure elements and extend them radially outward for the gripping of a surrounding web sleeve.

Examples of these prior art shafts are shown in U.S. Pat. Nos. 3,493,189, 3,552,672, 3,904,144 and 4,473,195.

These expandable shafts of the prior art are customarily made of aluminum or machined steel composite cylinder bodies having steel end journals. The machined steel cylinder bodies are used to support the larger weight and the higher stiffness applications. The weight of these steel expandable shafts is often excessive and frequently outside the current OSHA weight limits for lifting by individuals without mechanical assistance. The manufacturing of the previous composite shafts required many process steps and are labor and cost intensive. The aluminum shafts on the other hand, are limited to lighter weights and less stiffness dependent applications.

Some of the disadvantages of the prior art were attempted to be overcome by U.S. Pat. No. 5,379,964 which discloses an expandable shaft having a cylindrical core and a plurality of elongated rails bonded to the outer circumference of the core. The core may be formed of a composite material as well as the rails. However, this shaft of the prior art in which one of the applicants herein is a co-inventer lacked the flexural stiffness and resistance to buckling required in many applications.

It is to these and other disadvantages of the prior art that the current design is directed to.

SUMMARY OF THE INVENTION

The expandable shaft of the present invention is of the slotted type employing fiber reinforced composite materials.

Shafts of such materials have considerable advantages over the metallic shafts of the prior art. In particular, they have a higher specific stiffness, higher specific strength and are of considerably lighter weight than the steel and aluminium shafts that are in current use.

The shafts of the present invention can take various forms and in a preferred embodiment an isogrid structural shell formed of aluminum extrusions or fiber/resin pultrusions. The shaft includes a central shell having a cylindrical core and radially outward rails that are integral and formed together by either the above mentioned extrusion or fiber/resin pultrusion methods. Further, the isogrid shell rails contain elongated openings extending parallel with the shaft axis that receive composite stiffener elements. The plurality of composite stiffeners are formed preferably by a process in which resin and fibers are pulled through the isogrid rail openings resulting in substantially parallel fibers running the length of the shaft which is of the desired uniform cross section. The shell rails form elongated slots and within each slot there is located a pressure member and an elongated bladder which when inflated serves to extend the pressure member radially outward. The unit is completed by appropriate end journals and a fluid conduit arrangment for bladder inflation.

Accordingly, it is a primary object of the present invention to provide an improved expandable shaft of the slotted type that is formed of a fiber reinforced material to provide desirable physical characteristics of weight, stiffness strength and cost competitive.

It is another object of the present invention to provide a method of making an expandable slotted shaft of hybrid design using fiber reinforced composite materials and metal isogrid structure.

It is a still further object of the present invention to provide an expandable slotted shaft of a design that is efficient in operation and has advantageous mechanical characteristics.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which.

DESCRIPTION OF THE PREFERRED EMBODIMENT

Figure 4:
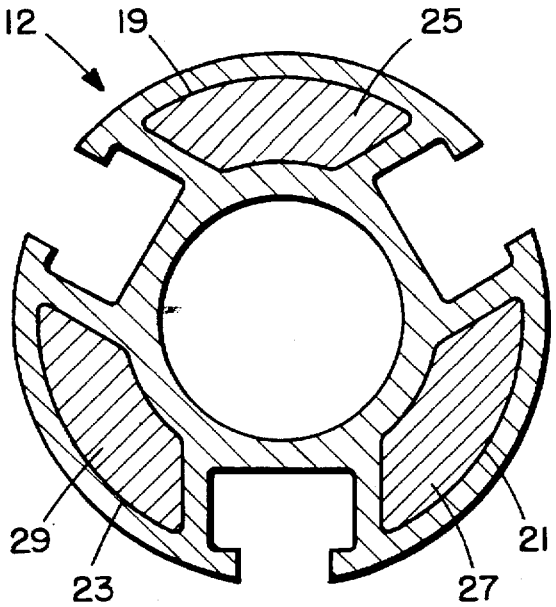
FIG. 4 is a sectional view of the isogrid structural shell and the composite stiffeners.
Figure 7:
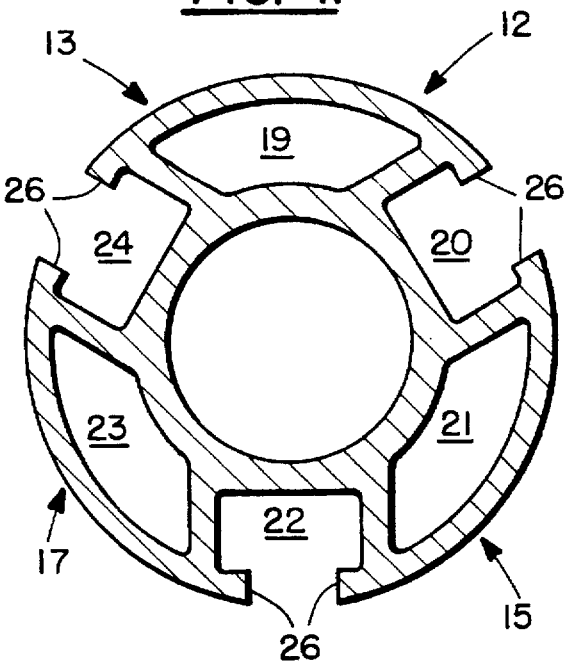
FIG. 7 is a sectional view of the isogrid structural shell.

Referring now to the drawings the expandable shaft is generally shown as 10 and includes a isogrid shell 12 shown in cross section in FIGS. 4 and 7.

The shell is an integral unitary unit and serves as the main support element of the shaft 10. In the embodiment shown, the shell 12 includes a cylindrical core 11 and three elongated rails 13, 15 and 17 extending the length of the shell, parallel to the axis thereof and of arcuate outer contour. Each rail 13, 15, 17 has an elongated opening 19, 21, 23 respectively extending the length of the shell. The openings are preferably of arcuate cross section as seen in FIGS. 4 and 7.

The isogrid shell 12 may be made from an aluminum extrusion to form the shell core 11 and the three rail structures. An alternative is to form the shell as a composite pultrusion. This alternative may be made with both unidirectional and braided continuous reinforcing fiber and a polymer matrix. As a result of this type of fabrication, the fibers are at various angles throughout the length of the isogrid shell to provide high resistance to torsional deflection of the isogrid shell.

Composite materials are well known and consist of two or more subtances that, unlike the metals of an alloy, remain differentiated within the combined material. In the composite used herein, a reinforcing fiber of carbon or glass is embedded in a polymer matrix material and a thermoset or thermoplastic resin serves as the matrix material.

The high strength and stiffness of carbon fibers combined with their low density provides composites with ten times the specific tensile strength of steel and aluminum, and approximately four times the specific modulus. Furthermore, the unique combination of carbon fiber properties provides composites with significant mechanical benefits overall when compared with fiberglass, ceramic and Kevlar fibers.

The two type of fibers and their properties suitable for the present shaft are the following:

| Fiber Type | Strength (KS) | Modulus (MS) | Density (Lb/in 3) |
|---|---|---|---|
| Graphite | 350 | 92 | 0.079 |
| Graphite | 700 | 34 | 0.0625 |

The openings 19, 21, 23 are filled with a composite stiffeners 25, 27, 29 preferably by a process in which the resin and fibers are pulled through the openings resulting in substantially parallel fibers running the length of the stiffener. This results in the fibers extending substantially parallel throughout the length thereof which is a particularly important feature of the present invention. It has been found that this provides the desirable stiffness for the completed shaft.

An important aspect of the present invention is the method of fabricating the shaft. Slotted expandable shafts of the steel type are commonly formed of a single unitary steel element which is machined to provide appropriate slots. To do this with a composite shaft, as herein described, would be difficult and expensive. Such a process with a composite shaft would require special high speed tools with diamond edges which tend to degrade the structural properties of composites. Aluminum shafts are usually extruded, a process that is not applicable to composite materials.

It is seen that the three rails 13, 15, 17 are equally spaced circumferentially forming three slots 20, 22 and 24 which also extend the axial length of the shell 12. Although three rails and three slots are shown, it is understood that the shell 12 could be formed having more or less than three rails, and a corresponding number of slots.

Located within each slot is a pressure member generally indicated by 28 which consists of a flat base element 30 and a series of rubber pads 32 that are bonded to the strip 30. The pressure member 28 thus comprises an elongated, inverted T and when located within the slot the outer edges of the strip 30 are located under rail lips 26 as more clearly seen in FIG. 6.

Located under each pressure member 28 is an inflatable bladder 34 made of a suitable flexible material such as rubber. A metal fixture 36 having an opening is fitted in the underside of one end of each bladder whereby air or other fluid can be passed into the bladder for inflation. The ends of the bladders are sealed by clamps 37 secured in place by machine screws 39 received in the core.

A pair of end journals 38 and 40 are provided at the two ends of the shaft for suitable mounting. Journal 38 has an axial bore 42 and a plurality of radial bores 44 to connect the pneumatic source with the individual bladder inlet fixture 36. A collar 43 surrounding each journal fits over the reduced ends 46 of the shaft 10. A series of U-shaped leaf springs 48 are located in each slot above the respective strip 30 and below the lips 26 of the rails. The purpose of the leaf springs is to urge the pressure member 28 radially inward when its respective bladder is deflated.

Figure 1:
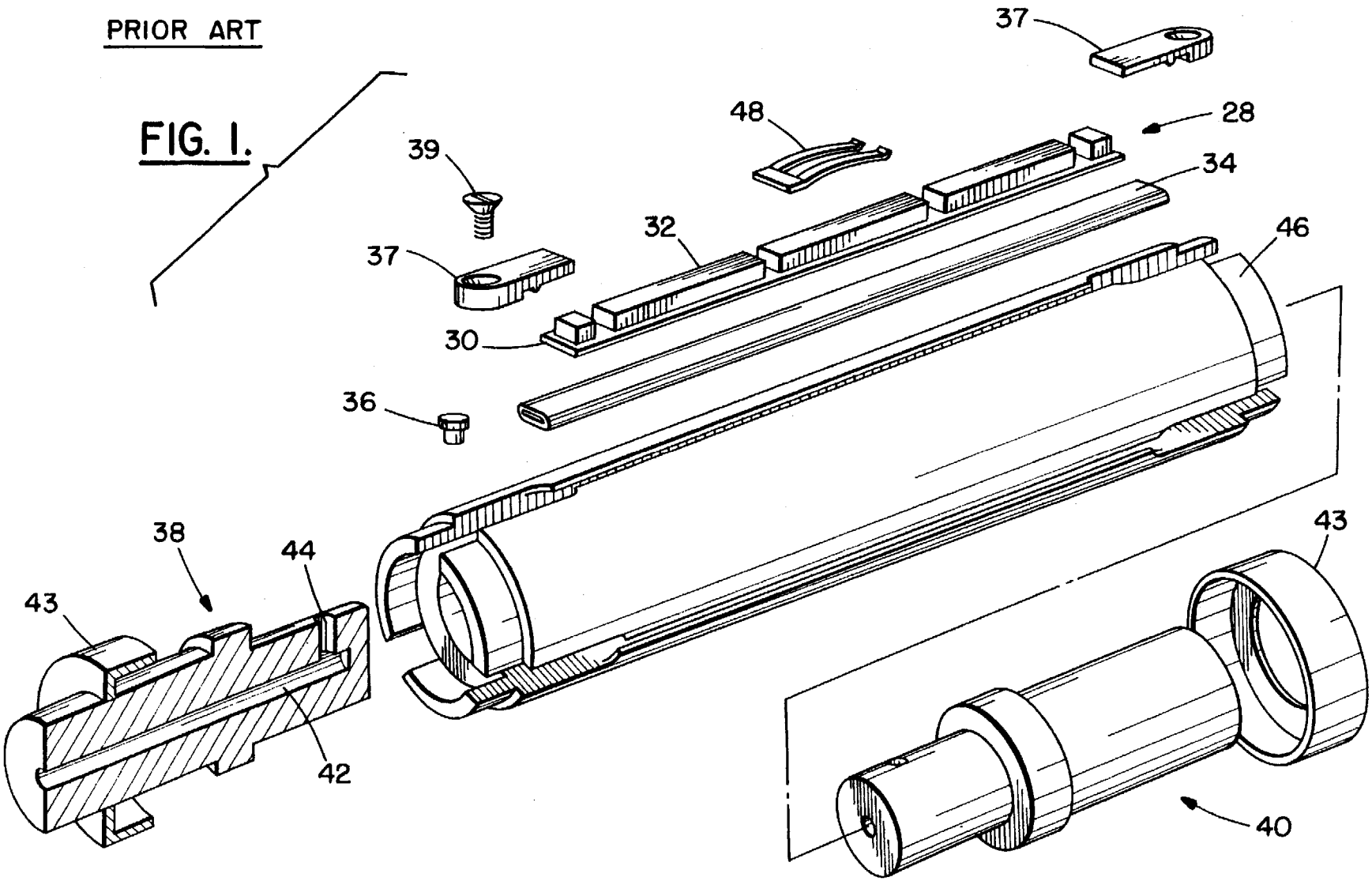
PRIOR ART FIG. 1.
FIG. 1 is an exploded view of an expandable shaft of the present invention.
Figure 2:
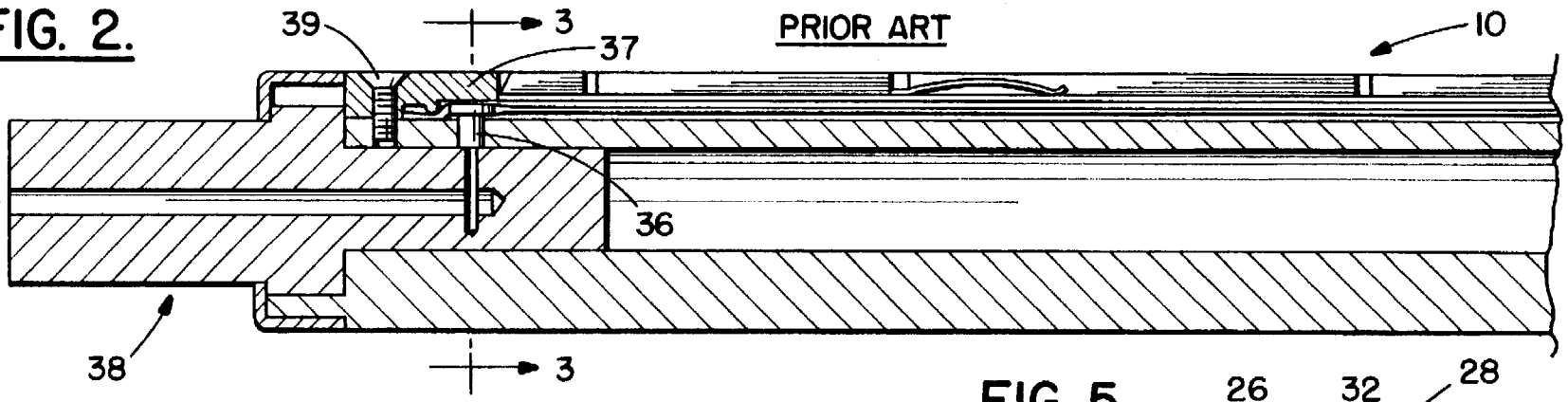
FIG. 2 is a sectional view of the shaft of FIG. 1.
Figure 5:
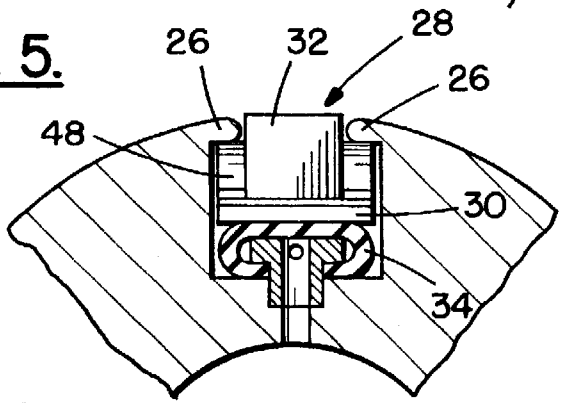
FIG. 5. PRIOR ART
FIG. 5 is a detailed view of a cross section of a single slot with the bladder deflated.
Figure 6:
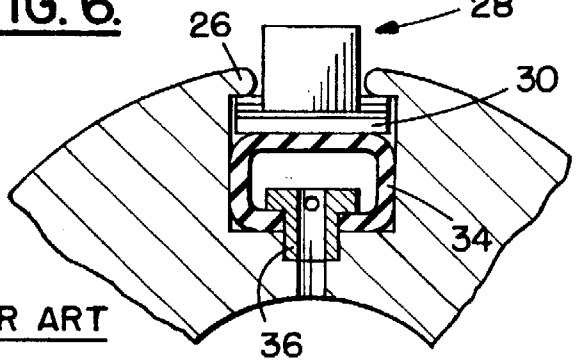
FIG. 6. PRIOR ART
FIG. 6 is a view similar to FIG. 5 with the bladder expanded.
Figure 3:
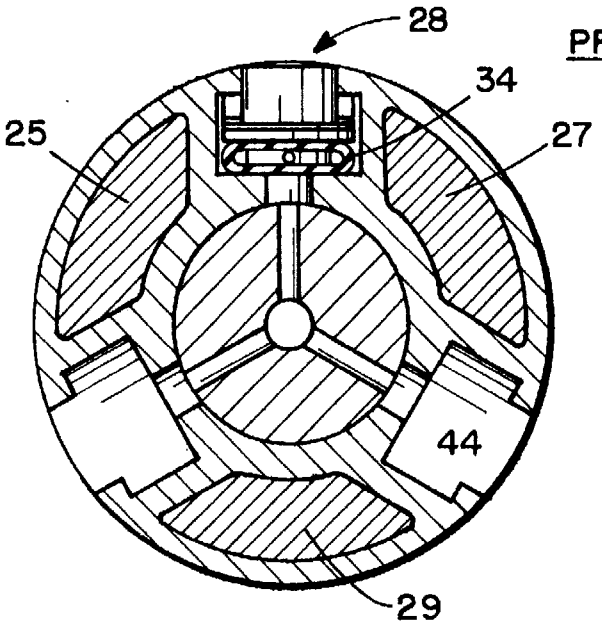
FIG. 3 is a sectional view taken on the line 3—3 of FIG. 2.

FIG. 5 illustrates the deflated condition of bladder 34 and it is seen that spring 48 is curved with the upper arm members bearing against lips 26 to urge member 30 radially inward. FIG. 6 illustrates the bladder in an inflated position with the springs 48 flattened and pressure member 28 extended radially outward.

In summary, the shafts of the present invention can take various forms and in a preferred embodiment an isogrid structural shell 12 is formed of aluminum extrustions or fiber/resin pultrusions. The plurality of composite stiffeners 25, 27, 29 are formed preferably by a process in which the resin and fibers are pulled through the isogrid structural shell rails 13, 15, 17 resulting in substantially parallel fibers running the length of the composite stiffener which is of the desired uniform cross section.

Having thus described the invention with particular reference to the preferred forms thereof, it will be obvious that various changes and modifications may be made therein without departing from the spirit and scope of the invention as defined in the appended claims.

What is claimed is:

1. An expandable shaft comprising:

an elongated metallic shell structure having a central axis, a cylindrical metallic core and a plurality of rails positioned outward from the cylindrical core and extending parallel to the central axis of the shell structure;

said rails being spaced apart to form slots extending parallel with the shell axis;

pressure protrusions located within each slot and adapted to be moved radially outward;

inflatable means located within each slot to selectively move said pressure protrusion means radially outward;

each of said plurality of rails having an elongated opening of accurate cross section therein; and a composite fibrous stiffener material substantially filling each said opening.

2. The expandable shaft of claim 1 in which the composite fibrous stiffener material includes fibrous materials extending substantially parallel with the axis of said shaft.

3. The expandable shaft of claim 2 in which the fibrous material includes carbon fibers.

4. The expandable shaft of claim 2 in which the fibrous material includes glass fibers.

5. The expandable shaft of claim 1 in which said elongated shell structure is formed of an aluminum extrusion.

6. An expandable shaft comprising:

an isogrid metallic shell having a central axis an elongated core and a plurality of rails extending outward from the core and axially of the isogrid shell;

said isogrid shell being formed of a composite material of carbon fiber in an organic matrix;

said rails being equally spaced apart to form equally spaced slots extending parallel with the shell axis;

pressure protrusions located within each slot and adapted to be moved radially outward;

means located within each slot to selectively move said pressure protrusion means radially outward;

each of said plurality of rails having an elongated opening of generally arcuate cross section therein;

a composite fibrous stiffener material formed of carbon fiber in an organic matrix substantially filling each said rail opening; and the said carbon fibers extending substantially longitudinally of the axis of said shaft.

7. An expandable shaft comprising:

an isogrid shell having a central shell axis, an elongated core and a and a plurality of rails extending outward from the core and axially of the isogrid shell;

said rails being equally spaced apart to form equally spaced slots extending parallel with the shell axis;

pressure protrusions located within each slot and adapted to be moved radially outward;

means located within each slot to selectively move said pressure protrusion means radially outward; each of said plurality of rails having an elongated opening therein;

a composite fibrous stiffener material formed of carbon fiber in an organic matrix substantially filling each said rail opening; and the said carbon fibers extending substantially longitudinally of the shell axis.

* * * * *